United States Patent [19]

Smith

[11] 4,138,019

[45] Feb. 6, 1979

[54] MOUNTING DEVICE

[75] Inventor: Jack R. Smith, Jacksonville, Fla.

[73] Assignee: Frito-Lay, Inc., Dallas, Tex.

[21] Appl. No.: 812,726

[22] Filed: Jul. 5, 1977

[51] Int. Cl.[2] ..... A47F 7/00

[52] U.S. Cl. ..... 211/87; 211/190; 248/214; 248/226.1; 248/298

[58] Field of Search ..... 248/214, 215, 226 B, 248/DIG. 3, 298, 235, 258, 270, 287, 226.1; 211/87, 86, 176, 207, 208; 108/47

[56] References Cited

U.S. PATENT DOCUMENTS

| | | | |
|---|---|---|---|
| 1,370,453 | 3/1921 | Kilgour | 248/298 |
| 1,394,988 | 10/1921 | Folberth | 248/226 B |
| 1,571,753 | 2/1926 | Christian | 108/47 UX |
| 1,617,670 | 2/1927 | Cry | 248/226 B |
| 1,876,478 | 9/1932 | Van Duzer | 248/226.1 X |
| 2,602,499 | 7/1952 | Ault | 248/265 |
| 2,665,869 | 1/1954 | Samuels | 211/87 X |
| 2,810,136 | 10/1957 | Kearney | 248/298 |
| 2,920,853 | 1/1960 | Bufogle | 248/214 |
| 2,986,627 | 5/1961 | Marriett | 248/298 X |
| 3,202,292 | 8/1965 | Deliso | 248/DIG. 3 |

FOREIGN PATENT DOCUMENTS

| | | | |
|---|---|---|---|
| 129292 | 8/1950 | Sweden | 248/235 |

*Primary Examiner*—Roy D. Frazier
*Assistant Examiner*—Robert W. Gibson, Jr.
*Attorney, Agent, or Firm*—Bernard & Brown

[57] ABSTRACT

A device for mounting on a generally horizontal support surface, suitable for use in a retail outlet for holding packaged goods on display such as bagged food items, for example potato chips. The device has first and second angle members, each having an opening through a first leg, at least one of the openings being an elongated slot. The first angle member also has an opening, which may be an elongated slot, through its second leg. The two angle members are fastened together by a bolt passing through the openings in the first legs of the two angle members. A second bolt attaches an upright support strip to the angle member whose second leg has an opening. The support strip has an attachment opening, permitting its attachment to the mounting device, and at any of several heights when there is a plurality of such openings. The support strip has a support opening, and preferably a plurality of such openings. One or more supports are inserted into desired ones of the support openings to support packaged goods on display, or the supports on a plurality of support strips positioned along the length of the horizontal support surface may serve to hold generally horizontal shelving for goods being displayed. If desired, the second angle member can have an opening through its second leg, and means can be inserted therethrough to increase the stability of attachment of the display mount on a horizontal support surface.

15 Claims, 6 Drawing Figures

FIG. 3
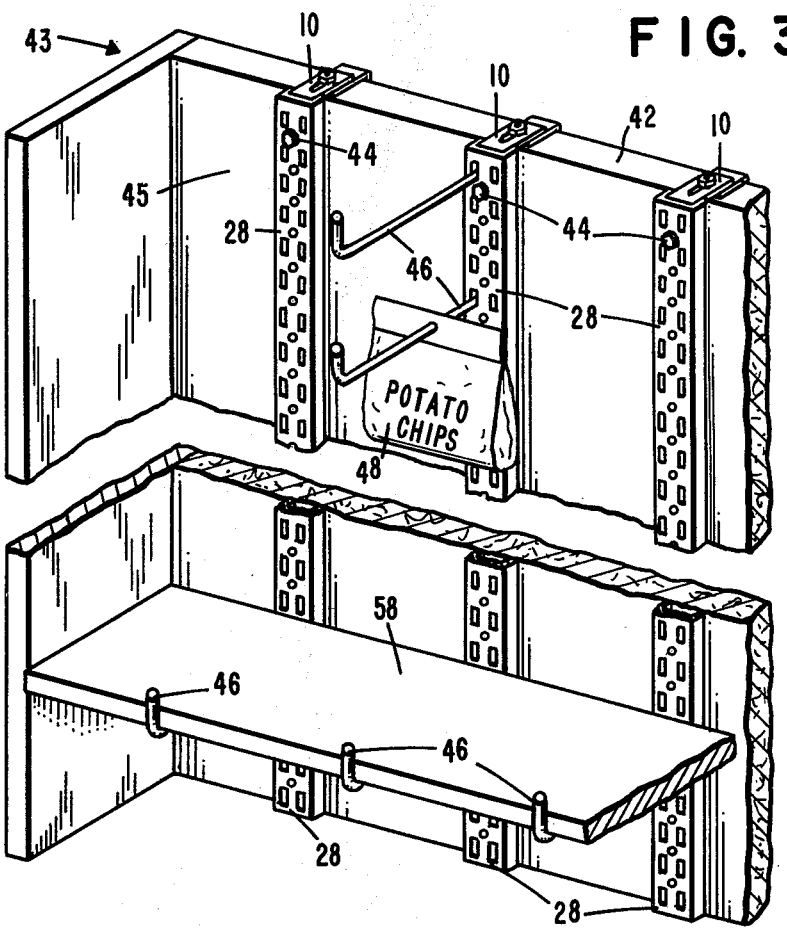
FIG. 4
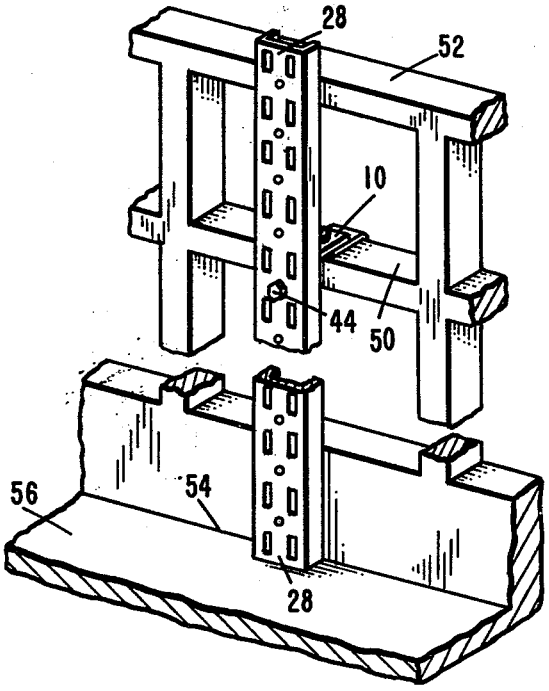
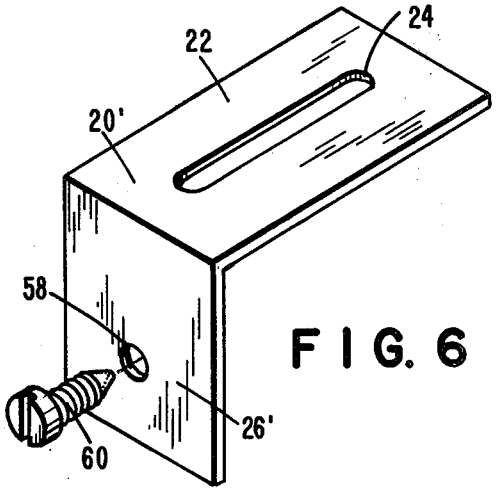
FIG. 6

MOUNTING DEVICE

This is a continuation of application Ser. No. 560,214, filed Mar. 20, 1975, now abandoned.

The present invention is a device for mounting support structures on a generally horizontal support surface. More particularly, the present invention may be used as a device for mounting commodities on a support surface for purposes of display and sale.

Many types of retail merchandise are packaged in manners which lend themselves to the hanging or shelving of the goods for display at the point of sale. By way of example, many prepared food items such as potato chips are packaged in bags having a small hole in or adjacent to the upper sealed surface of the bag so that each bag can be hung from a hook-like device for display at the retail outlet. To utilize this requires that a sufficient number of hooks be mounted for supporting a large number of such bags.

There have also been developed devices for supporting shelving in retail outlets which shelving is to hold various goods on display. Unfortunately, neither these support devices nor the shelving is well suited for support of goods packaged in bags for hanging, and their installation is complex and time consuming. Consequently, considerable effort is required to adapt such available devices for display of bagged goods. The problem is complicated by the fact that the various display racks or gondolas found in retail outlets are of different sizes, making it impossible to have one fixed size of display mount for hanging or shelving displays of goods such as bagged items.

The present invention is a mounting device adapted for use in conjunction with a horizontal support surface such as those in a retail outlet for holding packaged goods on display, such as bagged food items, for example bagged potato chips. In accordance with the present invention, the device has first and second angle irons, each having an opening through one leg thereof with at least one of these openings being an elongated slot. At least one of the angle irons has a second opening passing through its second leg. Connection means are provided for passing through the opening in the first legs of the two angle irons to adjustably connect the two angle irons in a saddle configuration for support from a horizontal support surface. A support strip is provided with one or more attachment openings and at least one, and preferably more, support openings. Further connection means are provided for passing through one of the support strip attachment openings and the opening in the second leg of one of the angle irons to attach the support strip to that angle iron. The support strip is thus mounted on the horizontal support surface by hanging the saddle formed by the angle irons on the support surface. A number of support members can then be removably positioned in the support strip support openings to hold packaged goods such as potato chips. A plurality of support strips can be so mounted on the horizontal support surface with a support member positioned on each to hold generally horizontal shelving for display of goods.

Previous attempts at mounting support members for holding packaged goods and shelving have included fastening a hood of fixed size to one end of a support strip so that the support strip could then be hung from a horizontal support surface. This arrangement, however, totally lacked any adaptability to unique conditions and sizes of various horizontal support surfaces and was found to offer generally no particular advantage over fastening the support strip directly to a vertical support surface by screws. Consequently, this prior arrrangement achieved no significant commercial use.

The flexibility of width of the saddle formed by the angle irons permits use of the mounting device of the present invention with horizontal support surfaces of a wide range of widths. Additionally, the mounting device can be mounted on a horizontal support surface of any desired height with the support strip extending above and/or below the mounting device for any desired angle. The mounting device of the present invention can be rapidly installed. This ease of installation and adaptability to a wide variety of support surfaces results in the mounting device being particularly suited for use in a wide variety of locations.

These and other aspects and advantages of the present invention are more apparent in the following detailed description and claims, particularly when considered in conjunction with the accompanying drawings in which like parts bear like reference numerals. In the drawings:

FIG. 3 illustrates use of mounting devices in accordance with the present invention to support bagged items for display in alternative manners from a first form of horizontal support surface;

FIG. 4 illustrates use of a mounting device in accordance with the present invention with a second form of horizontal support surface;

FIG. 6 illustrates an alternative embodiment of one component suitable for incorporation into a mounting device in accordance with the present invention.

Figure 1:
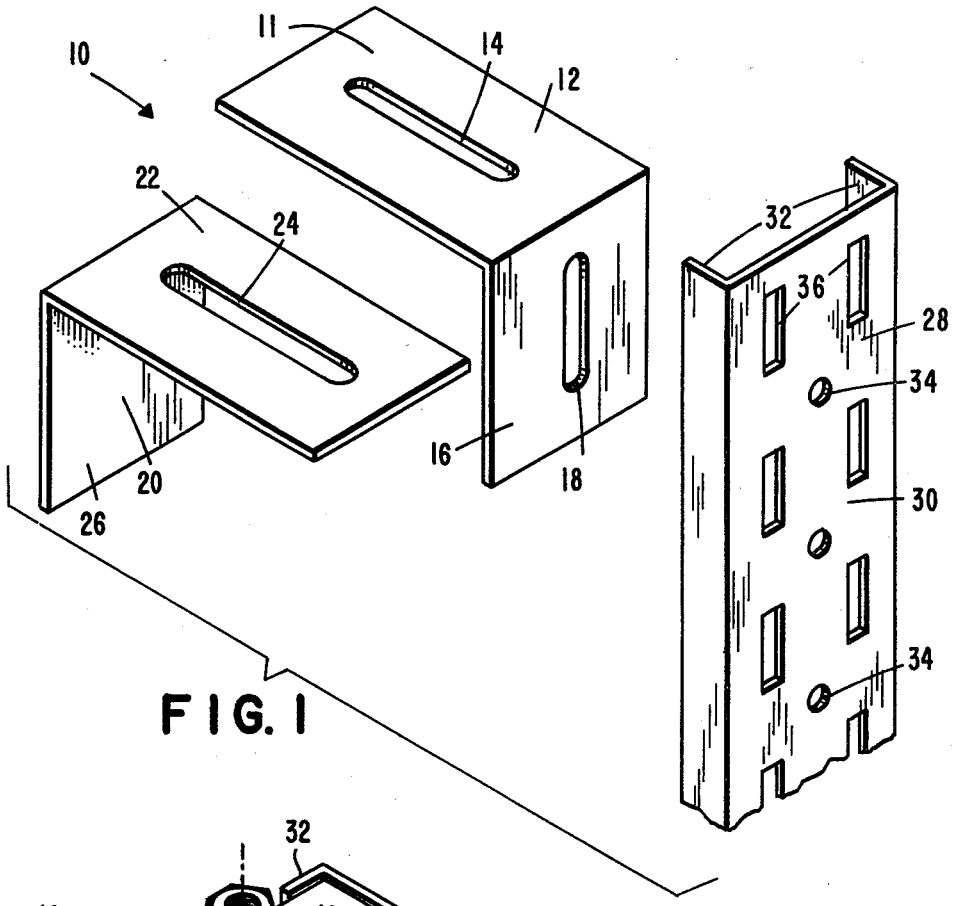
FIG. 1 is an exploded view of the major components of a mounting device in accordance with the present invention.

FIG. 1 depicts the major components of a mounting device 10. First angle iron member 11 has a first leg portion 12 with an opening 14 therethrough and a second leg portion 16 with an opening 18 therethrough. Second angle iron member 20 includes a first leg portion 22, having an opening 24 therethrough, and a second leg portion 26. In both angle iron member 11 and angle iron member 20, the two leg portions extend at substantially right angles to each other. At least one of openings 14 and 24 is an elongated slot whose longer dimension is positioned lengthwise of its respective leg and, therefore, generally perpendicular to the junction of that leg and the second leg of its angle iron. Preferably, as depicted in FIG. 1, both openings 14 and 24 are such elongated slots, and in addition opening 18 may be such a slot. Support strip or upright 28 includes front portion 30 and flange portions 32 which extend in the same direction and at substantially right angles from front portion 30. Front portion 30 is of a width slightly greater than the width of second leg portion 16 so that portion 16 fits snugly between flange portions 32. Support strip 28 might be any desired length depending upon the location of its installation. Front portion 30 includes one or more attachment openings 34 which are preferably circular openings of a radius in the order of, for instance, about three-sixteenths inch. As shown, opening 34 are preferably substantially centered across the width or lateral dimension of support strip 28 and are spaced at intervals, for example in the order of about one inch apart along the length of the support strip. Front portion 30 further includes one or more support openings 36. FIG. 1 depicts support openings 36 in the form of a plurality of elongated slots spaced two across the width or laterally on support strip 28, with the longest dimension of the slots generally parallel to the length of the support strip. As an example, slots 36 may have a length in the order of about ½ inch and may be spaced apart by a distance in the order of about ½ inch, with an attachment opening 28 between each pair of support openings 36.

Figure 2:
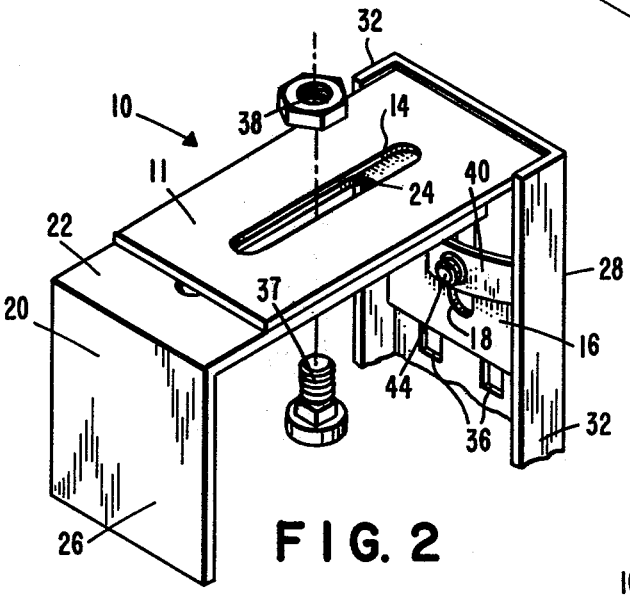
FIG. 2 illustrates the components of a mounting device in accordance with the present invention assembled in a first manner for support from a horizontal support surface.

FIG. 2 shows a first manner of assembly of the components of FIG. 1 to provide a display mount for packaged items. As seen in FIG. 2, angle iron members 11 and 20 are juxtaposed with first leg portion 12 overlaying first leg portion 22. Bolt 37 passes through slots 14 and 24 to mate with nut 38, retaining angle iron members 11 and 20 together. Slots 14 and 24 permit adjustment of the distance between second leg members 16 and 26. Leg member 16 is positioned between flanges 32 of support strip 28. A bolt 44 passes through one of the attachment openings 34 and through opening 18 of leg portion 16 to mate with a nut 40, retaining support strip 28 on leg portion 16. Conveniently, a clip-type speed nut can be used for nut 40 so that it is not necessary to reach behind leg portion 16 in order to engage nut 40 on bolt 44.

FIG. 3 illustrates display mount 10 with angle iron members 11 and 20 fastened together as illustrated in FIG. 2 and positioned on horizontal support surface 42 of display stand 43 which has a generally vertical back 45. First leg portions 12 and 22 are positioned so that second leg portions 16 and 26 fit snugly against the opposite surfaces of vertical back 45. To mount support strip 28 in this manner, clip-type speed nut 40 is clipped onto leg portion 16 to overlie opening 18, bolt 37 is passed through openings 26 and 18, and nut 38 is loosely fastened on bolt 37. Angle members 11 and 20 are then positioned over horizontal support surface 42 and adjusted to bring leg portions 16 and 26 tightly against vertical back 45. Nut 38 is then tightened. Bolt 37 preferably includes a generally square portion fitting within slots 24 and 14 to prevent rotation of bolt 37 as nut 38 is tightened; thus, conveniently bolt 37 can be an elevator bolt. Support strip 28 is then positioned as desired on leg portion 16, and bolt 44 is passed through an attachment opening 34 and mated with speed nut 40. Alternatively, support strip 28 may be attached to leg portion 16 before angle members 11 and 20 are positioned over horizontal support surface 42.

Support rods 46 are provided with attachment ends which cooperate with attachment openings 36 to mount support rods 46 from support strip 28. The large number of support openings 36 permits use of a large number of support rods 46 in a wide variety of locations so that a large number of packaged items 48 can be mounted for display. For purposes of clarity, FIG. 3 shows only two support rods 46 and shows a single package 48, depicted in FIG. 3 as a bag of goods, but, as can be appreciated from FIG. 3, a large number of support rods 46 and packages 48 might be supported from a single support strip 28. In addition, FIG. 3 shows lower support rods 46 supported from additional support strips 28, which are also mounted from horizontal support surface 42 by mounting devices in accordance with the present invention, to support generally horizontal shelf member 58 on which additional packaged goods can be displayed.

FIG. 4 illustrates attachment of display mount 10 from a horizontal support surface 50 of a grill or framework 52. Angle members 11 and 20 are attached to horizontal support surface 50 in a manner similar to the attachment on horizontal support surface 42 of FIG. 3. Support strip 28 is attached to leg member 16 so that support strip 28 extends both above and below angle members 11 and 20.

FIG. 4 also illustrates support strip 28 extending to the bottom surface 54 of grill 52 to abut against lower surface or base 56 which might be a floor or a horizontal surface of grill 52. The abutment of support strip 28 against surface 56 may help to prevent swinging of support strip 28. Preferably, opening 18 is an elongated slot to permit fine adjustment of the height of support strip 28 to permit firm abutment of support strip 28 against surface 56. Support strip 28 can be any desired length and, by way of example, might extend up to 6 feet or more.

Figure 5:
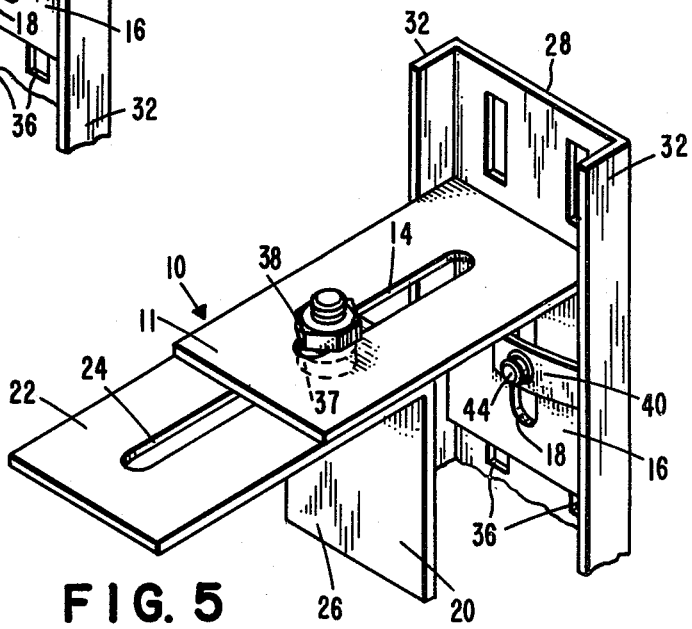
FIG. 5 illustrates the components of a mounting device in accordance with the present invention assembled in a second manner for support from a horizontal support member.

Leg members 16 and 26 are positioned a distance apart which causes them to fit tightly against the opposite surfaces of vertical back 45. Should vertical back 45 be of a width less than the length of first leg portions 12 and 22 of angle members 11 and 20, then angle member 20 can be rotated to the position depicted in FIG. 5 so that second leg portion 26 is adjacent second leg portion 16. First leg portions 12 and 22 may have, for example, a length in the order of two and a half inches, and so assembly as depicted in FIG. 2 would be appropriate for vertical backs with a width of 2 inches or more, while assembly as depicted in FIG. 5 would be appropriate for narrower vertical backs. By having each of openings 14 and 24 in the form of an elongated slot, maximum flexibility is possible, and angle iron members 11 and 20 can be supported on the horizontal support surface of a vertical back of any width within a wide range.

If desired, for additional stability, the second angle iron member can be formed as second angle iron member 20', depicted in FIG. 6, having first leg portion 22 with elongated slot 24 therethrough and second leg portion 26' with threaded opening 58 therethrough. A pointed bolt 60 is provided to mate with threaded opening 58. When this embodiment of angle iron member is utilized, after nut 38 is tightened to hold leg portions 16 and 26 against vertical back 45, bolt 60 is inserted to engage vertical back 45, providing additional stability.

Although the present invention has been described with reference to preferred embodiments, modifications and rearrangements can be made, and still the result would be within the scope of the invention.

What is claimed is:

1. An adjustable mounting device suitable for use with a horizontal support surface to hold packaged goods on display, said mounting device comprising:

a first angle member having a first leg portion, with an opening therethrough, and a second leg portion, with an elongated slot therethrough, said second leg portion extending at substantially a right angle from said first leg portion, said second leg portion elongated slot being generally perpendicular to the junction of the first angle member first leg portion and second leg portion;

a second angle member having a first leg portion with an opening therethrough, and a second leg portion, said second leg portion extending at substantially a right angle from said first leg portion;

at least one of said first angle member first leg portion opening and said second angle member first leg portion opening being an elongated slot whose length is generally perpendicular to the junction of the first leg portion and the second leg portion of that angle member;

first connecting means for passing through said first angle member first leg portion opening and said second angle member first leg portion opening to adjustably connect said first and second angle members for support on a horizontal support surface;

said first leg portion of said second angle member being capable of parallel placement beneath said first leg portion of said first angle member with said second leg portion of said second angle member being alternatively positionable either closer to said second leg portion of said first angle member than said opening in said first leg portion of said second angle member, or farther from said second leg portion of said first angle member than said opening in said first leg portion of said second angle member;

an elongated support strip having a plurality of attachment openings therethrough spaced at intervals along the length of said support strip and a first plurality of support openings therethrough spaced at intervals along the length of said support strip;

said first angle member second leg portion elongated slot being registerable with each of said plurality of attachment openings;

second connecting means for passing through each of said plurality of attachment openings for adjustably locating said first and second angle members at a predetermined position along the length of said support strip whereby said angle members can be attached to said support strip along its length at each of said plurality of attachment openings and further adjusted along said second leg portion elongated slot of said first angle member, as well as adjustably connected to each other for attaching said support strip to said horizontal surface enabling adjustment in a vertical and horizontal position; and support means removably extending from at least one of said support openings.

2. A mounting device as claimed in claim 1 in which both said first angle member first leg portion opening and said second angle member first leg portion opening are elongated slots whose length is generally perpendicular to the junction of the respective angle member first leg portion and second leg portion.

3. A mounting device as claimed in claim 1 in which said second connecting means comprises a bolt and a clip-type speed nut.

4. A mounting device as claimed in claim 1 in which said second connecting means comprises a bolt and a clip-type speed nut.

5. A mounting device as claimed in claim 1 in which the support opening is an elongated slot whose length is generally lengthwise of said support strip.

6. A mounting device as claimed in claim 1 in which the second angle member second leg portion has a threaded opening therethrough and in which said mounting device further comprises means mating with the threaded opening and positioned to engage a vertical surface of the horizontal support surface.

7. A mounting device as claimed in claim 1 in which said elongated support strip has a second plurality of support openings therethrough spaced at intervals along the length of said support strip with each of said plurality of support openings of said second plurality horizontally aligned with a support opening of said first plurality.

8. A mounting device as claimed in claim 7 in which the support openings of said first plurality are vertically aligned and the support openings of said second plurality are vertically aligned.

9. A mounting device suitable for use with a horizontal support surface to hold packaged goods on display, said mounting device comprising:

a first angle member having a first leg portion with an opening therethrough, and a second leg portion, with an elongated slot therethrough, said second leg portion extending at substantially a right angle from said first leg portion, said second leg portion elongated slot being generally perpendicular to the junction of the first angle member first leg portion and second leg portion;

a second angle member having a first leg portion, with an opening therethrough, and a second leg portion, said second leg portion extending at substantially a right angle from said first leg portion;

at least one of said first angle member first leg portion opening and said second angle member first leg portion opening being an elongated slot whose length is generally perpendicular to the junction of the first leg portion and the second leg portion of that angle member;

first connecting means for passing through said first angle member first leg portion opening and said second angle member first leg portion opening to adjustably connect said first and second angle members for support on a horizontal support surface;

an elongated support strip having an extended length and having an attachment opening therethrough, a first plurality of vertically aligned support openings therethrough spaced at intervals along the length of said support strip, and a like plurality of vertically aligned support openings therethrough spaced at intervals along the length of said support strip with each support opening of said like plurality horizontally aligned with a support opening of said first plurality, said support openings being elongated slots extending lengthwise of said support strip;

second connecting means for passing through said support strip attachment opening and said first angle member second leg portion elongated slot to adjustably attach said support strip to said first angle member; and support means removably extending from at least one of said support openings.

10. A mounting device as claimed in claim 9 in which said support strip has a plurality of attachment openings spaced along the length of said support strip.

11. A mounting device as claimed in claim 9 in which both said first angle member first leg portion opening and said second angle member first leg portion opening are elongated slots whose length is generally perpendicular to the junction of the respective angle member first leg portion and second leg portion.

12. A mounting device suitable for use with a horizontal support surface to hold packaged goods on display, said mounting device comprising:

a first angle member having a first leg portion, with an opening therethrough, and a second leg portion, with an opening therethrough, said second leg portion extending at substantially a right angle from said first leg portion, each of said openings being elongated slots whose length is generally perpendicular to the junction of said first leg portion and said second leg portion;

a second angle member having a first leg portion, with an opening therethrough, and a second leg portion, said second leg portion extending at substantially a right angle from said first leg portion, said opening being an elongated slot whose length is generally perpendicular to the junction of the first leg portion and the second leg portion;

first connecting means for passing through said first angle member first leg portion opening and said second angle member first leg portion opening to adjustably connect said first and second angle members for support on a horizontal support surface;

said first leg portion of said second angle member being capable of parallel placement beneath said first leg portion of said first angle member with said second leg portion of said second angle member being alternatively positionable either closer to said second leg portion of said first angle member than said opening in said first leg portion of said second angle member, or farther from said second leg portion of said first angle member than said opening in said first leg portion of said second angle member;

an elongated support strip having a plurality of attachment openings therethrough spaced at intervals along the length of said support strip, and a first plurality of of support openings therethrough spaced at intervals along the length of said support strip;

said first angle member second leg portion elongated slot being registerable with each of said plurality of attachment openings;

second connecting means for passing through each of said plurality of attachment openings for adjustably locating said first and second angle members at a predetermined position along the length of said support strip whereby said angle members can be attached to said support strip along its length of each of said plurality of attachment openings and further adjusted along said second leg portion elongated slot of said first angle member, as well as adjustably connected to each other for attaching said support strip to said horizontal surface enabling adjustment in a vertical and horizontal position; and support means removably extending from at least one of said support openings.

13. The mounting device of claim 12 in which a slidable connecting means is located in said opening in the second leg portion of said first angle member.

14. A mounting device as claimed in claim 12 in which said elongated support strip has a second plurality of support openings therethrough spaced at intervals along the length of said support strip with each of said plurality of support openings of said second plurality horizontally aligned with a support opening of said first plurality.

15. A mounting device as claimed in claim 14 in which the support openings of said first plurality are vertically aligned and the support openings of said second plurality are vertcially aligned.

* * * * *